US005879535A

United States Patent [19]

Serrand et al.

[11] Patent Number: 5,879,535

[45] Date of Patent: Mar. 9, 1999

[54] TWO-STAGE PROCESS FOR OBTAINING SIGNIFICANT OLEFIN YIELDS FROM RESIDUA FEEDSTOCKS

[75] Inventors: Willibald Serrand, Buxheim, Germany; Mitchell Jacobson, West Orange, N.J.; Michael R. Parrish, Morristown, N.J.; David G. Hammond, Madison, N.J.

[73] Assignee: Exxon Research and Engineering Company, Florham Park, N.J.

[21] Appl. No.: 768,343

[22] Filed: Dec. 17, 1996

[51] Int. Cl.[6] ..... C10G 9/28

[52] U.S. Cl. ..... 208/126; 208/67; 208/72; 208/77; 208/153; 208/163; 585/648

[58] Field of Search ..... 208/67, 72, 77, 208/126, 153, 163; 585/648

[56] References Cited

U.S. PATENT DOCUMENTS

| | | | |
|---|---|---|---|
| 2,768,127 | 10/1956 | Kimberlin, Jr. et al. | 208/50 |
| 3,019,272 | 1/1962 | Steinhofer et al. | 585/301 |
| 3,290,405 | 12/1966 | Rosenberg | 585/500 |
| 4,263,128 | 4/1981 | Bartholic | 208/91 |
| 4,985,136 | 1/1991 | Bartholic | 208/153 |
| 5,167,795 | 12/1992 | Gartside | 208/67 |
| 5,435,905 | 7/1995 | Davis et al. | 208/53 |
| 5,714,663 | 2/1998 | Serrand et al. | 585/648 |

OTHER PUBLICATIONS

H. Weiss, J. Schmalfeld. "Coking of Residue Oils by the LR–Process" Sonderdruck aus Erdol & Kohle – Erdgas – Petrochemie/Hydrocarbon Technology. 42, 235–237 (1989) – no month.

H.J. Weiss, J. Schmalfeld. "Coking of Oil Sand, Asphaltenes and Residual Oils in the LR–Process" Fourth UNITAR/UNDP Intl.Conf. on Heavy Crude & Tar Sands (paper #144) – no date.

H. Weiss, J. Schmalfeld, R.B. Solari. "Coking of Oil Sands, Asphaltenes and Residual Oils in the LR–Process", paper presented at the 5th UNITAR Conference Aug. 9, 1988.

*Primary Examiner*—Walter D. Griffin
*Assistant Examiner*—Nadine Preisch
*Attorney, Agent, or Firm*—Henry E. Naylor

[57] ABSTRACT

A two-stage process for obtaining a substantial amount of olefinic product from a residua feedstock. The first stage is comprised of a thermal process unit containing a reaction zone comprised of a horizontal moving bed of fluidized hot particles operated at temperatures from about 500° to 600° C. and having a short vapor residence time, and the second stage thermal conversion zone operated at a temperature of about 700° C. to about 1100° C., and also having a short vapor residence time.

10 Claims, 1 Drawing Sheet

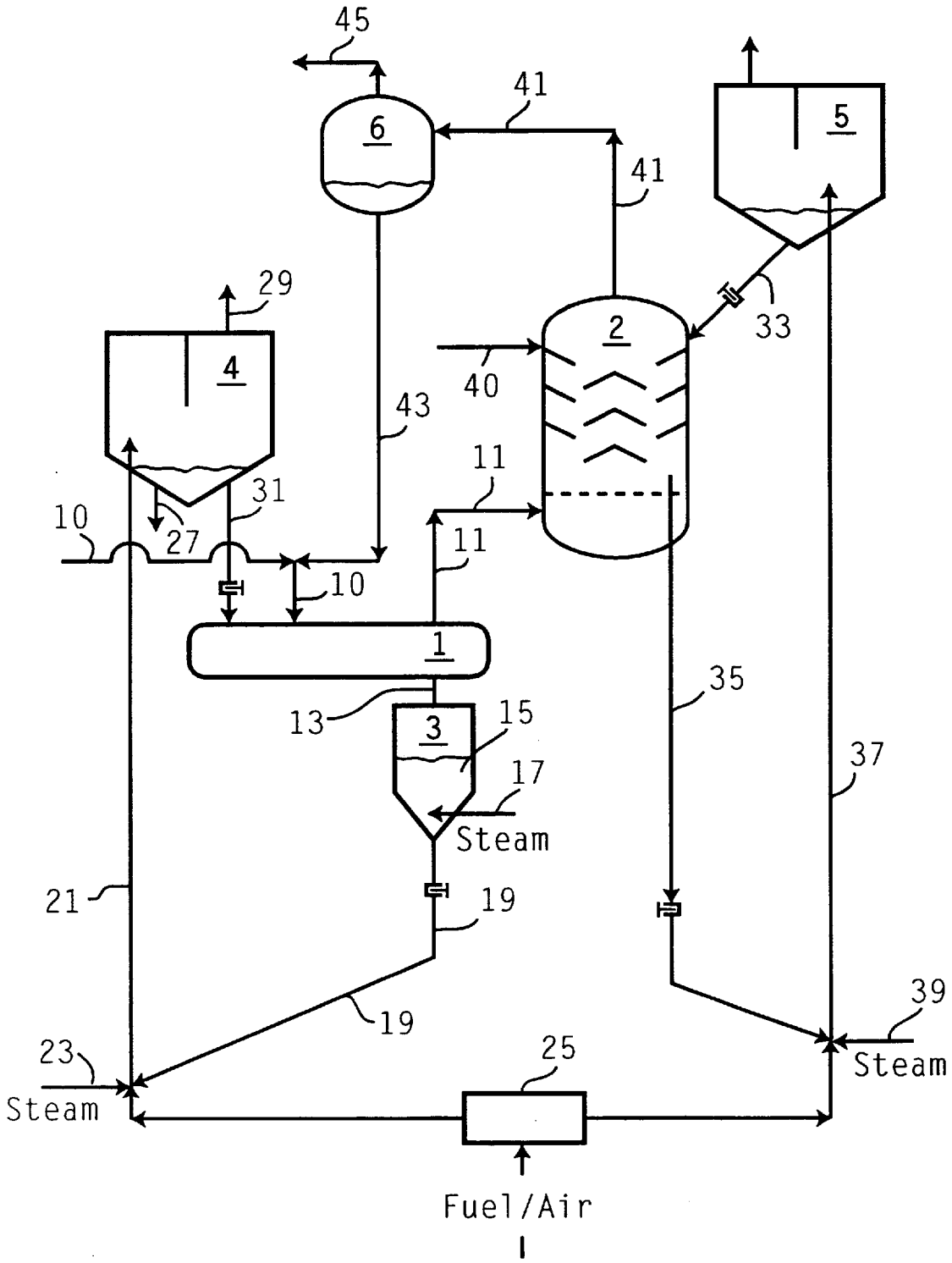
45
41
6
41
5
29
33
2
4
40
43
11
31
10
27
11
10
1
35
13
15
3
37
17
Steam
21
19
39
19
23
25
Steam
Steam
Fuel/Air

TWO-STAGE PROCESS FOR OBTAINING SIGNIFICANT OLEFIN YIELDS FROM RESIDUA FEEDSTOCKS

BACKGROUND OF THE INVENTION

The present invention relates to a two-stage process for obtaining a substantial amount of olefinic product from a residua feedstock. The first stage is comprised of a thermal process unit containing a reaction zone comprised of a horizontal moving bed of fluidized hot particles operated at temperatures from about 500° to 600° C. and having a short vapor residence time, and the second stage thermal conversion zone operated at a temperature of about 700° C. to about 1100° C., and also having a short vapor residence time, preferably shorter than that of the first stage reaction zone.

BACKGROUND OF THE INVENTION

In a typical refinery, crude oils are subjected to atmospheric distillation to produce lighter fractions such as gas oils, kerosenes, gasolines, straight run naphtha, etc. Petroleum fractions in the gasoline boiling range, such as naphthas, and those fractions which can readily be thermally or catalytically converted to gasoline boiling range products, such as gas oils, are the most valuable product streams in the refinery. The residue from atmospheric distillation is distilled at pressures below atmospheric pressure to produce a vacuum gas oil distillate and a vacuum reduced residual oil which often contains relatively high levels of asphaltene molecules. These asphaltene molecules typically contain most of the Conradson Carbon residue and metal components of the residua. It also contains relatively high levels of heteroatoms, such as sulfur and nitrogen. Such feeds have little commercial value, primarily because they cannot be used as a fuel oil owing to ever stricter environmental regulations. They also have little value as feedstocks for refinery processes, such as fluid catalytic cracking, because they produce excessive amounts of gas and coke. Their high metals content also leads to catalyst deactivation. Thus, there is a need in petroleum refining for better ways to utilize residual feedstocks or to upgrade them to more valuable, cleaner, and lighter feeds.

Unlike residual feedstocks, more valuable feedstocks like gas oils are used in fluid catalytic cracking to produce transportation fuels as well as being used in steam crackers to make olefinic chemical products. A steam cracker is a thermal process unit comprised of fired coils where the feedstock is cracked at temperatures of about 540° to 800° C. in the presence of steam. While gas oils are adequate feedstocks for such purposes, they are also relatively expensive feedstocks because they are a preferred feedstock for producing transportation fuels. It would be desirable, from an economic point of view, to use lower valued feeds, such as residual feeds, in a steam cracker, but they are generally not suitable for such use because they are susceptible to excessive cracking, coke formation, and coke deposition in the cracking coils which leads to overheating and equipment plugging. In addition, it has been found that steam can react with coke at process temperatures to form substantial amounts of CO which dilutes product vapors and seriously complicates product recovery.

An attempt to overcome these problems was made in U.S. Pat. No. 2,768,127 which teaches the use of residual feedstocks for the production of aromatic and olefinic product streams. This is accomplished by contacting the residua feedstock in a fluidized bed of coke particles maintained at a temperature from about 675° to 760° C. While such a process is useful, there remains a need for improved processes for obtaining olefinic products from residual feedstocks without excessive cracking of product vapors.

Co-pending application U.S. Pat. Ser. No. 08/606,153 filed Feb. 23, 1996, now U.S. Pat. No. 5,714,663, and incorporated herein by reference, teaches a single stage process for obtaining a substantial amount of olefinic products from a residua feedstock by use of a short vapor contact time thermal process unit comprised of a horizontal moving bed of fluidized hot particles. While such a process is an improvement over the art, there is still a need for further improvements in the higher temperature ranges.

SUMMARY OF THE INVENTION

In accordance with the present invention, there is provided a two stage process for producing olefins from a residual feedstock, which process comprises converting the feedstock in two stages, wherein:

(1) the first stage is comprised of:
- (i) a first stage heating zone wherein solids containing carbonaceous deposits are received from a stripping zone and heated in the presence of an oxidizing gas;
- (ii) a first stage reaction zone containing a horizontal moving bed of fluidized hot solids, which reaction zone is operated at a temperature from about 500° C. to about 600° C. and under conditions such that the solids residence time and the vapor residence time are independently controlled, which vapor residence time is less than about 2 seconds, and which solids residence is from about 5 to about 60 seconds; and
- (iii) a stripping zone through which solids having carbonaceous deposits thereon are received from the reaction zone and wherein lower boiling hydrocarbons and volatiles are recovered with a stripping gas; and (2) the second stage is comprised of:
- (i) a second stage heating zone wherein solids containing carbonaceous deposits are received from the second stage reaction zone;
- (ii) a second stage reaction zone which is operated at a temperature from about 700° C. to about 1100° C. and at vapor residence times of less than about 1 second;

which process comprises:

(a) passing said residual feedstock to said first stage reaction zone where it is contacted with fluidized hot solids thereby resulting in a vaporized fraction and a solids fraction having high Conradson Carbon components and metal-containing components being deposited thereon;

(b) separating the vaporized fraction from the solids fraction;

(c) passing the solids fraction to a stripping zone wherein low boiling hydrocarbons and volatile material are stripped therefrom by contacting them with a stripping gas;

(d) passing the stripped solids to said first stage heating zone where they are heated in an oxidizing environment to an effective temperature that will result in the production of flue gases and maintain the operating temperature of said first stage reaction zone when the solids are passed to the said reaction zone;

(e) separating the flue gas product from the solids of said first stage heating zone;

(f) recycling hot solids from said first stage heating zone to said first stage reaction zone where they are contacted with fresh feedstock;

(g) passing the vaporized fraction of said first stage to said second stage reaction zone where they are contacted with hot solids at a temperature from about 700° C. to about 1100° C. and at vapor residence times of less than about 1 second;

(h) separating a vapor fraction from a solids fraction;

(i) passing said solids fraction to a second stage heating zone where they are heated to an effective temperature that will combust carbonaceous deposits thereon and that will maintain the operating temperature of said second stage reaction zone when said solids are passed to said second stage reaction zone; and (j) recycling hot solids from said second stage heating zone to said second stage reaction zone where they are contacted with the vapor product from said first stage reaction zone.

In a preferred embodiment of the present invention, the vapor product from the second stage reaction zone is quenched to a temperature below which cracking will not occur and a vapor phase product containing substantial amounts of olefins are recovered.

BRIEF DESCRIPTION OF THE FIGURE

The sole FIGURE hereof is a schematic flow plan of a non-limiting preferred embodiment of the present invention.

DETAILED DESCRIPTION OF THE INVENTION

Residual feedstocks which are suitable for use in the present invention are those petroleum fractions boiling above about 480° C., preferably above about 540° C., more preferably above about 560° C. Non-limiting examples of such fractions include vacuum resids, atmospheric resids, heavy and reduced petroleum crude oil; pitch; asphalt; bitumen; tar sand oil; shale oil; sludge, slop oils, heavy hydrocarbonaceous waste, and lube extracts. It is understood that such residual feedstocks may also contain minor amounts of lower boiling material. These feedstocks typically cannot be used as feeds to steam crackers to produce olefinic products because they excessively coke. Such feeds will typically have a Conradson carbon content of at least 5 wt. %, generally from about 5 to 50 wt. %. As to Conradson carbon residue, see ASTM Test D189-165 .

Olefinic products are produced from the residual feedstocks in accordance with the present invention in a two stage system. The first stage contains a horizontal fluidized bed reaction zone wherein the solids and vapor residence times are independently controlled and the second stage contains a reaction zone operated at a temperature at least about 100° C. higher than the first stage and wherein the vapor residence time is also short, preferably shorter than that of the first reaction stage. Reference is now made to the sole figure hereof wherein a residual feedstock is fed via line 10 to a reaction zone 1 which contains a horizontal moving bed of fluidized hot solids and which is operated at a temperature from about 500° C. to about 600° C. The solids in the reaction zone will preferably be fluidized with assistance of a mechanical means. Typically, the particles will be fluidized by use of a fluidizing gas, such as steam, a mechanical means, and by the vapors which are produced in-situ by the vaporization of a fraction of the feedstock. It is preferred that the mechanical means be a mechanical mixing system characterized as having a relatively high mixing efficiency with only minor amounts of axial back-mixing. Such a mixing system acts like a plug flow system with a flow pattern which ensures that the residence for substantially all particles in the reaction zone will be substantially the same. The most preferred mechanical mixer is the mixer referred to by Lurgi AG of Germany as the LR-Mixer or LR-Flash Coker which was originally designed for processing oil shale, coal, and tar sands. The LR-Mixer consists of two horizontally oriented rotating screws which aid in fluidizing the particles. Although it is preferred that the solid particles be coke particles, they may also be any other suitable refractory particulate material. Non-limiting examples of such other suitable refractory materials include those selected from the group consisting of silica, alumina, zirconia, magnesia, mullite, synthetically prepared or naturally occurring material such as pumice, clay, kieselguhr, diatomaceous earth, bauxite, and the like. It is within the scope of the present invention that the solids be inert or that they have catalytic properties. The solids will have an average particle size of about 40 microns to 2,000 microns, preferably from about 200 microns to about 1200 microns.

The feedstock is contacted with the fluidized hot solids at a temperature high enough to cause a substantial portion of the high Conradson Carbon and metal-containing components to deposit on the hot solid particles in the form of high molecular weight carbon and metal moieties, but not so high as to cause the formation of substantial amounts of olefinic products. This will preferably be at a temperature from about 500° C. to about 600° C., more preferably from about 530° C. to 570° C. The remaining portion of the feedstock will be vaporized on contact with the hot solids. The residence time of vapor products in reaction zone 1 will be an effective amount of time so that substantial secondary cracking is minimized. This amount of time will typically be less than about 2 seconds. The residence time of solids in the reaction zone will be from about 5 to 60 seconds, preferably from about 10 to 30 seconds. One novel aspect of this first stage reaction zone is that the residence times of the solids and the vapor phase can be independently controlled. Most fluidized and fixed bed processes are designed so that the solids residence time, and the vapor residence time cannot be independently controlled, especially at relatively short vapor residence times. It is also preferred that the short vapor contact time process unit be operated so that the ratio of solids to feed be from about 30 to 1, preferably 20 to 1, more preferably about 10 to 1, and most preferably from about 5 to 1. It is to be understood that the precise ratio of solids to feed will primarily depend on the heat balance requirement of the short vapor contact time reaction zone. Associating the solids to feed ratio with heat balance requirements is within the skill of those in the art, and thus will not be elaborated herein any further. A portion of the feedstock will deposit on the solids in the form of combustible carbonaceous material. Metal components will also deposit on the solids. Consequently, the vaporized portion will be substantially lower in both Conradson Carbon and metals when compared to the original feed.

Solids, having carbonaceous material deposited thereon, are passed from the first stage reaction zone 1 via line 13 to the bed of solids 15 in stripper 3. The solids pass downwardly through the stripper and past a stripping zone at the bottom section where lower boiling hydrocarbons and any remaining volatiles, or vaporizable material, are stripped from the solids by use of a stripping gas, preferably steam, introduced into the stripping zone via line 17. The stripped solids are passed via line 19 to lift pipe 21 where they are transferred to heater 4 with a lift medium, such as steam via line 23 and flue gas from burner 25 via line 42. Heat is provided by use of auxiliary burner 25. The first stage heating zone will typically be operated at a pressure ranging from about 0 to 150 psig, preferably at a pressure ranging from about 15 to about 45 psig. While some carbonaceous residue will be burned from the solids in the heating zone, it is preferred that only partial combustion take place so that the solids, after passing through the heater, will have value as a fuel. Excess solids can be removed from the process unit via line 27. Flue gas is removed overhead from heater 4 via line 29. The flue gas can be passed through a cyclone system (not shown) to remove most solid fines. Dedusted flue gas will be further cooled in a waste heat recovery system (not shown), scrubbed to remove contaminants and particulates, and passed to a CO boiler (not shown) to generate steam.

The vaporized fraction from the first stage reaction zone is passed via line 11 to the second stage reaction zone reactor 2. The operating temperature of this second stage reaction zone is from about 700° C. to about 1100° C., preferably from about 700° C. to about 900° C. Non-limiting examples of reactor designs which can comprise this second stage include a counter-current vessel wherein solids flow downwardly and vapor flows upward past the downward moving solids. The second stage reactor may also be a riser reactor wherein both solids and vapor flow upwards. While the second stage reaction vessel can be any design which will allow short vapor contact time, it is more preferred that it be a counter current design as discussed above. The vapor contact time of this reaction zone is preferably less than about 1 second, more preferably less than about 0.5 seconds. Hot solids are received from the heater 5 via line 33 and flow downwardly through second stage reactor 2. They are met by counter flowing vapor product stream from the first stage reaction zone which is introduced into second stage reaction zone via line 11. Excess solids can be removed from the second stage via line 42. Hot solids exit second stage reaction zone and are passed via line 35 to lift pipe 37 where they are transported to second stage heater 5 with steam which is injected via line 39 and hot flue gas from auxiliary burner 25 via line 44. A light boiling range hydrocarbon, preferably in the vapor phase, may be injected into the top section of second stage reaction zone 2 via line 40 to quench reaction products to substantially reduce detrimental secondary cracking. This will preferably require a 100° to 200° C. decrease in temperature of vapor phase products. The quench medium may be any suitable hydrocarbon, non-limiting examples which include liquid petroleum gas, and distillates.

Reaction products having significant olefinic content exit second stage reactor 2 via line 41 and are passed to scrubber 6 where they are further quenched to temperatures preferably below about 450° C., more preferably below about 340° C. Heavy products, including any particulates, are removed via line 43 and may be recycled to first stage reaction zone 1. Light products from scrubber 6 are removed overhead via line 45. The light product stream contains a substantial amount of olefins. For example, it will typically be a 510° C. minus product stream and contain about 7 to 10 wt. % methane, 12 to 18 wt. % ethylene, and 7 to 12 wt. % propylene, and 6 to 9 wt. % unsaturated $C_4^3$ s, such as butenes and butadienes, based on the total weight of the feed.

This vaporized portion will contain a substantial amount of olefinic products, typically in the range of about 20 to 50 wt. %, preferably from about 25 to 50 wt. %, and more preferably from about 30 to 50 wt. %, based on the total weight of the product stream. The olefin portion of the product stream obtained by the practice of the present invention will typically be comprised of about 5 to 15 wt. %, preferably about 7 to 10 wt. % methane; about 10 to 20 wt. %, preferably about 12 to 18 wt. % ethylene; and about 5 to 15 wt. %, preferably 7 to 12 wt. % propylene, based on the feed.

The following example is presented to show that a short contact time process mode is important for obtaining increased olefin yields from residual feedstocks.

EXAMPLE

A South Louisiana Vacuum Residua was used as the feedstock and was fed at a feedrate of 100 barrels/day to a short contact time fluid coking pilot unit. The operating temperature of the pilot unit was 745° C. at a vapor residence time of less than 1 second. Estimated conversion and product yields are set forth in Table I below.

TABLE I

| | |
|---|---|
| Temperature °C. | 745 |
| $C_3^-$ Conversion, wt. % on feed | 35 |
| Gas Yields wt. % on Feed | |
| Methane | 7–10 |
| Ethylene | 14–16 |
| Propylene | 9–12 |
| Unsaturated $C_4$'s | 6–9 |
| Liquid Yields wt. % on Feed | |
| $C_5$/220° C. | 17.5 |
| 220°/340° C. | 8.0 |
| 340° C.$^+$ | 13.0 |
| Total $C_5$+ | 38.5 |
| Gross Coke, wt. % on Feed | 18.7 |
| Olefin/Paraffin, wt. ratio | |
| Ethylene/Ethane | 6.0 |
| Propylene/Propane | 19.0 |
| Butylene/Butane | 30.0 |

What is claimed is:

1. A two stage process for producing olefins from a residual feedstock, which process comprises converting the feedstock in two stages, wherein:

(1) the first stage is comprised of:

(i) a first stage heating zone wherein solids containing carbonaceous deposits are received from a stripping zone and heated in the presence of an oxidizing gas;

(ii) a first stage reaction zone containing a horizontal moving bed of fluidized hot solids, which reaction zone is operated at a temperature from about 500° C. to about 600° C. and under conditions such that the solids residence time and the vapor residence time are independently controlled, which vapor residence time is less than about 2 seconds, and which solids residence is from about 5 to about 60 seconds; and (iii) a stripping zone through which solids having carbonaceous deposits thereon are received from the reaction zone and wherein lower boiling hydrocarbons and volatiles are recovered with a stripping gas; and (2) the second stage is comprised of:

(i) a second stage heating zone wherein solids containing carbonaceous deposits are received from the second stage reaction zone;

(ii) a second stage reaction zone which is operated at a temperature from about 700° C. to about 1100° C. and at vapor residence times of less than about 1 second;

which process comprises:

(a) passing said residual feedstock to said first stage reaction zone where it is contacted with fluidized hot solids thereby resulting in a vaporized fraction and a solids fraction having high Conradson Carbon components and metal-containing components being deposited thereon;

(b) separating the vaporized fraction from the solids fraction;

(c) passing the solids fraction to a stripping zone wherein low boiling hydrocarbons and volatile material are stripped therefrom by contacting them with a stripping gas;

(d) passing the stripped solids to said first stage heating zone where they are heated in an oxidizing environment to an effective temperature that will result in the production of flue gases and maintain the operating temperature of said first stage reaction zone when the solids are passed to the said reaction zone;

(e) separating the flue gas product from the solids of said first stage heating zone;

(f) recycling hot solids from said first stage heating zone to said first stage reaction zone where they are contacted with fresh feedstock;

(g) passing the vaporized fraction of said first stage to said second stage reaction zone where they are contacted with hot solids at a temperature from about 700° C. to about 1100° C. and at vapor residence times of less than about 1 second;

(h) separating a vapor fraction from a solids fraction;

(i) passing said solids fraction to a second stage heating zone where they are heated to an effective temperature that will combust carbonaceous deposits thereon and that will maintain the operating temperature of said second stage reaction zone when said solids are passed to said second stage reaction zone; and (j) recycling hot solids from said second stage heating zone to said second stage reaction zone where they are contacted with the vapor product from said first stage reaction zone.

2. The process of claim 1 wherein the vapor product from the second stage reaction zone is quenched to a temperature below which cracking will not occur and a vapor phase product containing about 20–50 wt. % of olefins is recovered.

3. The process of claim 1 wherein the vapor residence time of the first stage is less than about 2 seconds.

4. The process of claim 1 wherein the residua feedstock is selected from the group consisting of vacuum resids, atmospheric resids, heavy and reduced petroleum crude oil, pitch, asphalt, bitumen, tar sand oil, shale oil, sludge, slop oils, heavy hydrocarbonaceous waste, and lube extracts.

5. The process of claim 4 wherein the residua feedstock is a vacuum resid.

6. The process of claim 3 wherein the solids residence time of the first stage reaction zone is from about 10 to 30 seconds.

7. The process of claim 1 wherein the particles of the short vapor contact time first stage reaction zone are fluidized with the aid of a mechanical means.

8. The process of claim 7 wherein the mechanical means are comprised of set of horizontally disposed screws within the reactor.

9. The process of claim 1 wherein the second stage reaction zone is operated in counter current mode.

10. The process of claim 1 wherein the second stage reaction zone is operated in co-current mode using a riser reactor.

* * * * *